US012497800B1

(12) United States Patent
Sassano

(10) Patent No.: US 12,497,800 B1
(45) Date of Patent: Dec. 16, 2025

(54) FENCE IMPROVEMENT AND METHOD THEREFORE

(71) Applicant: Marco Antonio Sassano, Wimauma, FL (US)

(72) Inventor: Marco Antonio Sassano, Wimauma, FL (US)

( * ) Notice: Subject to any disclaimer, the term of this patent is extended or adjusted under 35 U.S.C. 154(b) by 330 days.

(21) Appl. No.: 18/110,125

(22) Filed: Feb. 15, 2023

(51) Int. Cl.
*E04H 17/14* (2006.01)

(52) U.S. Cl.
CPC ..... *E04H 17/1426* (2013.01); *E04H 17/1465* (2021.01)

(58) Field of Classification Search
CPC ..... E04H 17/1413; E04H 17/1417; E04H 17/1426; E04H 17/143; E04H 17/1439; E04H 17/1447; E04H 17/1448; E04H 17/1452; E04H 17/1456; E04H 17/146; E04H 17/1465; E04H 17/1486; E04H 17/17
USPC ..... 256/59, 65.01, 65.06, 65.07, 65.08, 66
See application file for complete search history.

(56) References Cited

U.S. PATENT DOCUMENTS 3,471,128 A * 10/1969 Jefferys ..... E04F 11/181 256/22
3,596,880 A * 8/1971 Greenberg ..... E04F 11/181 256/65.1
4,968,005 A * 11/1990 Zen ..... E04F 11/181 256/22
5,443,244 A * 8/1995 Gibbs ..... E04H 17/1439 256/22
5,454,548 A * 10/1995 Moore ..... E04H 17/1447 256/65.16
5,556,079 A * 9/1996 West ..... E04H 17/143 256/22
6,375,166 B1 * 4/2002 Schall ..... E04H 17/1439 256/59
6,398,193 B1 * 6/2002 DeSouza ..... E04H 17/1488 256/65.06
6,752,386 B1 * 6/2004 Bundy ..... E04H 17/1439 256/22
7,384,025 B2 * 6/2008 Lo ..... E04H 17/1439 256/65.13

(Continued)

FOREIGN PATENT DOCUMENTS

GB 2435886 A * 9/2007 ..... E04H 17/1439
WO WO-0155522 A1 * 8/2001 ..... E04F 11/1851

*Primary Examiner* — Amber R Anderson
*Assistant Examiner* — Kevin J Baynes
(74) *Attorney, Agent, or Firm* — QuickPatents; Kevin Prince

(57) ABSTRACT

The present invention is an improvement for a fence segment of the type having two vertical posts supported by a ground surface, and a bottom rail having two opposing ends and an upward-facing U-shaped channel configured for receiving a plurality of pickets. The bottom rail is disposed between the two vertical posts. The improvement includes a top rail having two opposing ends, a first tong projecting downwardly and configured to contact and retain the pickets at a first side of the top rail, the top rail disposed between the two vertical posts. A locking rail has two opposing ends, a second tong projecting downwardly, and is configured to contact and retain the pickets at an opposing second side of the top rail, the locking rail fixed with the top rail with a plurality of mechanical fasteners. Methods of use during expected high winds are also disclosed.

9 Claims, 5 Drawing Sheets

(56) References Cited

U.S. PATENT DOCUMENTS 7,635,115 B2 * 12/2009 Lehmann ..... E04H 17/1447 256/22
7,677,535 B1 * 3/2010 Lo ..... E04H 17/1439 256/65.01
8,317,164 B2 * 11/2012 Ash ..... E04H 17/1439 256/65.01
8,356,801 B2 * 1/2013 Howard ..... E04H 17/1439 256/22
8,413,332 B2 * 4/2013 Duffy ..... E04H 17/1417 29/897.31
8,491,246 B2 * 7/2013 Chao ..... F16B 21/02 411/347
8,695,949 B2 * 4/2014 Stinson ..... E04H 17/143 256/64
8,919,742 B2 * 12/2014 Williams, Sr. ..... E04H 17/1447 256/65.13
9,637,932 B2 * 5/2017 Schneider ..... E04H 17/1417
9,797,158 B2 * 10/2017 Springborn ..... E04F 11/1817
9,908,207 B2 * 3/2018 Springborn ..... E04F 11/1848
10,975,593 B2 * 4/2021 Walker ..... E04H 17/1439
11,035,147 B2 * 6/2021 Burt ..... E04H 17/1439
11,268,284 B2 * 3/2022 Ohrstrom ..... E04F 11/1817
2004/0188663 A1 * 9/2004 Stein ..... E04H 17/1439 256/59
2004/0245515 A1 * 12/2004 Perry ..... E04H 17/1488 256/65.07
2005/0045863 A1 * 3/2005 MacKay ..... E04H 17/1439 256/59
2005/0133777 A1 * 6/2005 Forbis ..... E04F 11/1836 256/59
2006/0081828 A1 * 4/2006 Gidseg ..... E04H 17/1447 256/59
2008/0121857 A1 * 5/2008 Lo ..... E04H 17/1439 256/65.01
2010/0264388 A1 * 10/2010 Duffy ..... E04H 17/1439 256/22
2011/0001105 A1 * 1/2011 Lo ..... E04H 17/1447 256/65.08
2011/0198552 A1 * 8/2011 Umosella, III ..... E04F 11/1817 256/65.08
2014/0346422 A1 * 11/2014 Langenwalter ..... E04H 17/1426 256/67
2015/0300041 A1 * 10/2015 Feeko ..... E04H 17/1417 29/525.08
2017/0234015 A1 * 8/2017 Bizzarri ..... E04F 11/1836 256/22
2021/0214936 A1 * 7/2021 Thomas ..... E04B 2/7836

* cited by examiner

FENCE IMPROVEMENT AND METHOD THEREFORE

STATEMENT REGARDING FEDERALLY SPONSORED RESEARCH AND DEVELOPMENT

Not Applicable.

FIELD OF THE INVENTION

This invention relates to fences, and more particularly to a fence that can be quickly disassembled when strong winds are expected.

BACKGROUND

High winds, such as those that occur during hurricanes, cyclones, and tornados, frequently destroy fences that have pickets or fence panels due to their relatively large surface areas. Previous solutions relating to static fences have employed two strategies: strengthening the fence to help it resist higher wind forces in situ, or designing the fence in such a way as to reduce drag in situ. Before expected high winds, it would be beneficial to be able to disassemble all or part of a fence to keep it from being damaged. Yet pickets are difficult to remove from such a fence without damaging the fence or completely disassembling it.

Therefore, there is a need for an improvement for such picket fences that would allow some or all of the pickets to be removed from the fence relatively easily. Such a needed invention would be easy to either install on an existing picket fence or install as a new picket fence. The improvement would not require any significant modifications of the vertical posts that support the top and bottom rails, nor the bottom rail or pickets. The present invention accomplishes these objectives.

SUMMARY OF THE INVENTION

The present invention is an improvement for a fence segment of the type having two vertical posts supported by a ground surface. The fence segment may be a part of a larger fence made from a plurality of the fence segments. The fence segment has a bottom rail having two opposing ends and an upward-facing U-shaped channel configured for receiving a plurality of pickets therein. Each picket, which herein includes the terms panel or fence panel, is preferably of the type that is generally flat and has a top end, a bottom end.

In such a fence segment, the improvement includes a top rail that has two opposing ends, a first tong, which is an extension or projection or flange, projecting downwardly, and that is configured to contact and retain the pickets at a first side of the top rail. The top rail is fixed between the two vertical posts and is substantially parallel to the bottom rail. The top rail may be formed by cutting off a second tong of a standard top rail that includes a downwardly-projecting U-shaped channel, which is similar to that of the bottom rail except inverted. This is preferably done with a router, by removing the top rail from the fence segment and then performing the cutting operation to remove the second tong. In this way existing fence segments can be retrofitted with the present improvement.

A locking rail has two opposing ends, and a second tong, which is an extension or projection or flange, projecting downwardly, and is configured to contact and retain the pickets at an opposing second side of the top rail. The locking rail is fixed with the top rail with a plurality of mechanical fasteners, such as regular screws, so-called "rivnuts," or other types of mechanical fasteners, as is known in the art.

In some preferred embodiments, the top rail and the locking rail are integrally formed with a living hinge formed therebetween, preferably at a top edge of the locking rail. Such a combination top rail and locking rail is preferably configured to be extruded with a resilient plastic material, such as PVC plastic, or with metal or other suitably rigid and strong material.

In use, with news of expected high winds such as during a hurricane, the mechanical fasteners can be removed from the fence segment to detach the locking rail from the top rail. The pickets are then removed and stored safely away from the inclement weather. Once the high winds have receded, the pickets are reinserted into the U-shaped channel of the bottom rail and positioned against the first tong of the top rail. Once the locking rail is in place, the mechanical fasteners may be reinstalled to affix the locking rail onto the top rail, thereby again locking the pickets in place.

During an initial installation of the improvement on an existing fence segment, the second tong may be first removed from the top rail so that the pickets are removable. The locking rail is then installed in its place.

The present invention is an improvement for picket fences that allows some or all of the pickets to be removed from the fence relatively easily. The present improvement is easy to either install on an existing picket fence or install as a new picket fence. The improvement does not require any significant modifications of the vertical posts that support the top and bottom rails, nor the bottom rail or pickets. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 2:
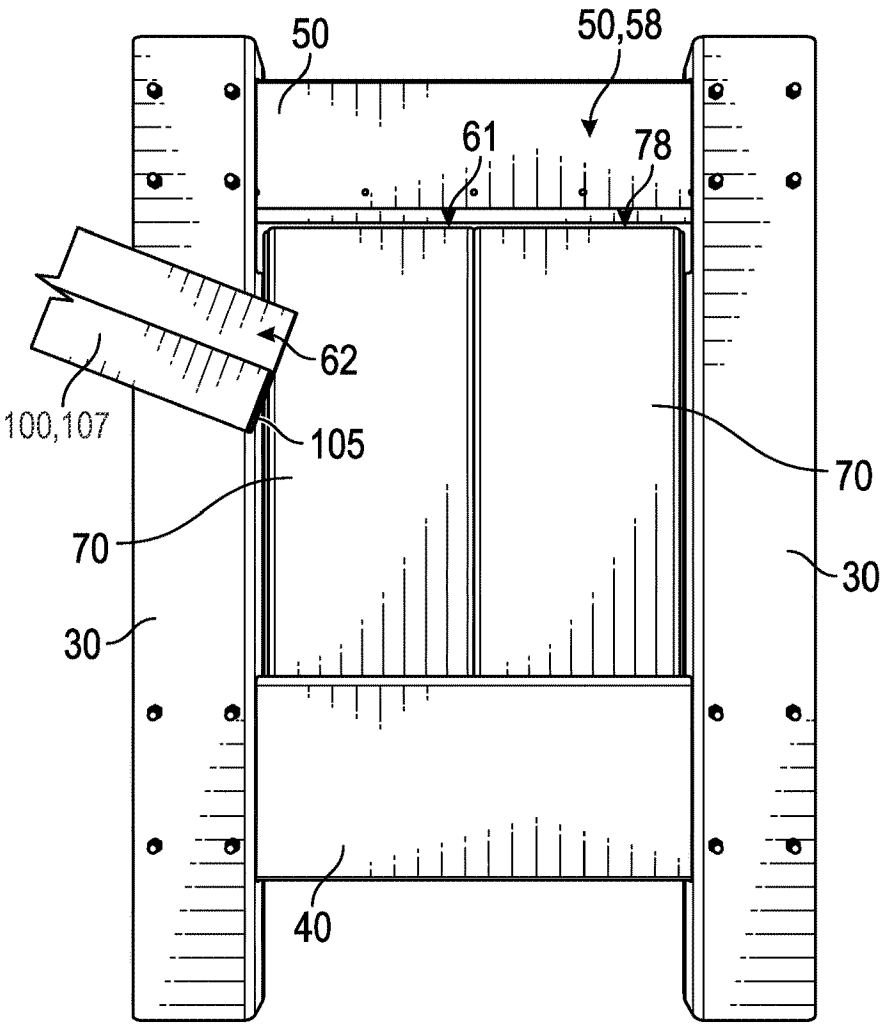
FIG. 2 is a front elevational view of the invention with a locking rail removed from a top rail.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-5 illustrate an improvement 10 for a fence segment 20 of the type having two vertical posts 30 supported by a ground surface 15. The fence segment 20 may be a part of a larger fence (not shown) made from a plurality of the fence segments 20. The fence segment 20 has a bottom rail 40 having two opposing ends 45 and an upward-facing U-shaped channel 60 configured for receiving a plurality of pickets 70 therein.

Each picket 70 is preferably of the type that is generally flat and has a top end 78, a bottom end 72, and in some embodiments side edges 75 that include a tongue 74 or a groove 76 such that the pickets 70 may be placed adjacent each other with the tongues 74 fitting within the grooves 76 (FIG. 3), as is known in the art. The bottom rail 40 is fixed between the two vertical posts 30.

In such a fence segment 20, the improvement 10 includes a top rail 50 that has two opposing ends 55, a first tong 61 projecting downwardly and configured to contact and retain the pickets 70 at a first side 52 of the top rail 50. The top rail 50 is fixed between the two vertical posts 30 and is substantially parallel to the bottom rail 40. The top rail 50 may be formed by cutting off a second tong 62 of a standard top rail 50 that includes a downwardly-projecting U-shaped channel 60 similar to that of the bottom rail 40 except inverted. This is preferably done with a router or table saw by removing the top rail 50 from the fence segment 20 and then performing the cutting operation to remove the second tong 62. In this way existing fence segments 20 can be retrofitted with the present improvement 10. Alternately, the top rail 50 may be formed by extrusion or other process with just the first tong 61.

A resilient spacer 63 (FIG. 5), made from an elastomeric, sponge, or foam material for example, may be included between the second tong 62 and the pickets 70, or between the first tong 61 and the pickets 70, to better secure the pickets 70 and prevent rattling thereof within the U-shaped channels 60. Such a resilient spacer 63 may alternately be applied with adhesive, staples, or the like to the top end 78 and the bottom end 72 of the pickets 70 to bind all of the pickets 70 together for easy collection when removing them from the fence segment 20.

Figure 12:
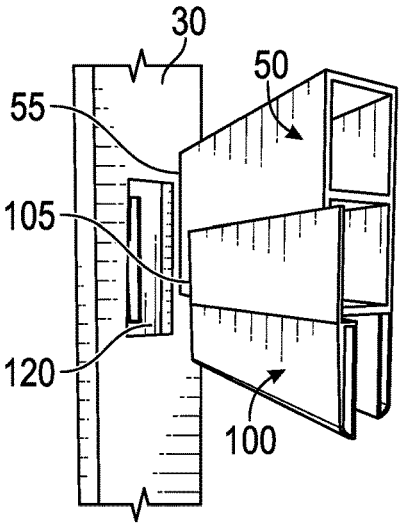
FIG. 12 is a partial perspective exploded view of an alternate embodiment of a vertical post.
Figure 13:
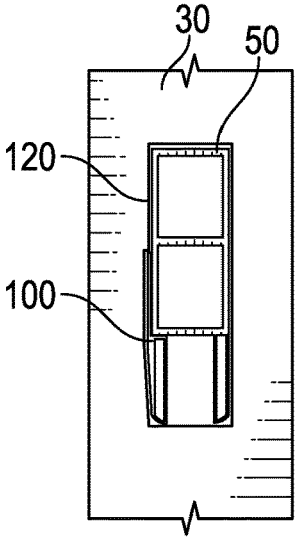
FIG. 13 is a side elevational view of the embodiment of FIG. 12.

A recess 120 (FIGS. 12-13) in each vertical post 30 is configured to receive one of the ends 55 of the top rail 50 and one of the ends 105 of the locking rail 100 when the locking rail 100 is affixed with the top rail 50. Preferably the vertical post 30 does not have to be modified in order to receive the combined top rail 50 and locking rail 100, but such a modification can be readily made with a router or other tool as necessary in the field.

Figure 9:
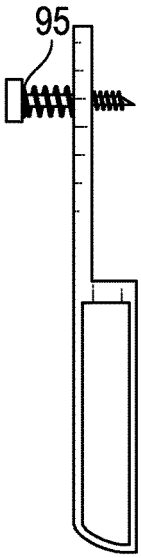
FIG. 9 is a side elevational view of an alternate embodiment of the locking rail, illustrating a spring-biased screw.

A locking rail 100 has two opposing ends 105, and a second tong 62 projecting downwardly and configured to contact and retain the pickets 70 at an opposing second side 58 of the top rail 50. The locking rail 100 is fixed with the top rail 50 with a plurality of mechanical fasteners 90, such as regular screws or spring-biased screws 95 (FIG. 9) that allow for the locking rail 100 to be pulled away from the top rail 50 and slid upwardly to release the spring-biased screws 95 through a keyhole aperture. Other types of mechanical fasteners 90 may be utilized as well, such as so-called "rivnuts," twist-lock or quarter-turn quick release fasteners, and the like, as is known in the art.

Figure 10:
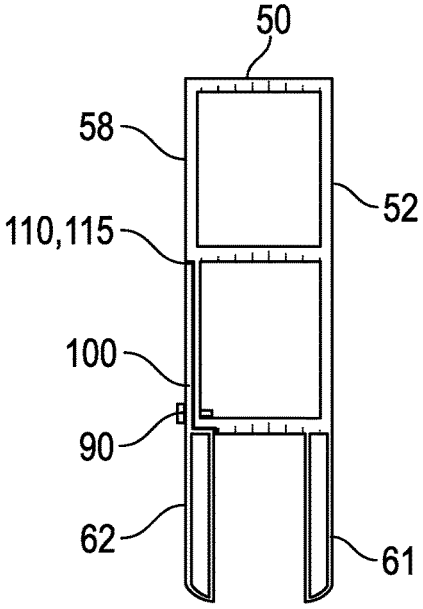
FIG. 10 is a side elevational view of an alternate embodiment of the locking rail and top rail.
Figure 11:
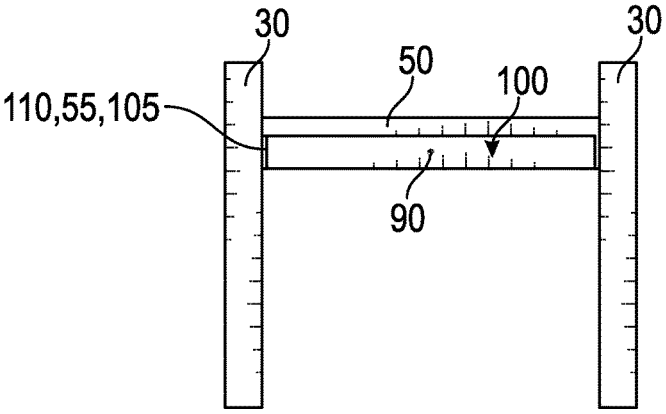
FIG. 11 is a front elevational view of an alternate embodiment of the locking rail and top rail.

In some preferred embodiments, the top rail 50 and the locking rail 100 are integrally formed with a living hinge 110 formed therebetween, preferably at a top edge 115 of the locking rail 100 (FIG. 10). Such a combination top rail 50 and locking rail 100 is preferably configured to be extruded with a resilient plastic material, such as PVC plastic or the like. In alternate embodiments, one of the ends 105 of the locking rail 100 is fixed with the living hinge 110 at one of the ends 55 of the top rail 50 (FIG. 11).

Figure 7:
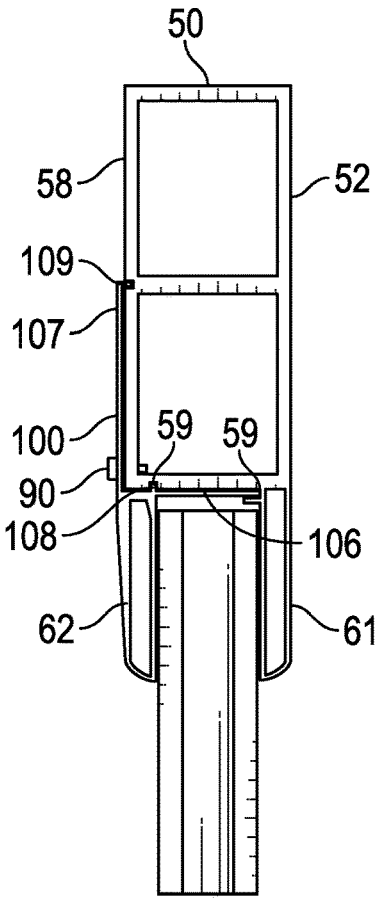
FIG. 7 is a side elevational view of an alternate embodiment of the invention, illustrating grooves of the top rail configured to receive the tangs or nibs of the locking rail.
Figure 8:
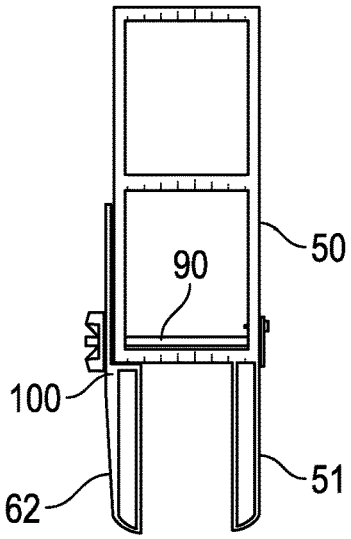
FIG. 8 is a side elevational view of an alternate embodiment of the invention, illustrating a bolt and wing nut mechanical fastener.

In some embodiments the locking rail 100 further includes a horizontal tang 106 (FIG. 7) configured to fit over the top end 78 of the pickets 70 when the locking rail 100 is fixed with the top rail 50, which helps counter torsion pressure experienced by the locking rail 100 when high wind conditions strike the pickets 70. The locking rail 100 may further include a vertical upper tang 107 configured to fit over a portion of the second side 58 of the top rail 50 when the locking rail 100 is fixed with the top rail 50. These tangs 106, 107 serve to strengthen the top rail 50 and the locking rail 100. Smaller nibs 108,109 may be included for engaging grooves 59 of the top rail 50 to further strengthen the improvement 10 against wind or other forces pressing against the pickets 70 or the rails 40,50.

In use, with news of expected high winds such as during a hurricane, the mechanical fasteners 90 can be removed from the fence segment 20 to detach the locking rail 100 from the top rail 50. The pickets 70 are then removed and stored safely away from the inclement weather. Once the high winds have receded, the pickets 70 are reinserted into the U-shaped channel 60 of the bottom rail 40 and moved towards the top rail 50, preferably with the locking rail 100. Once the locking rail 100 is in place, the mechanical fasteners 90 may be reinstalled to affix the locking rail 100 onto the top rail 50, thereby again locking the pickets 70 in place.

During an initial installation of the improvement 10 on an existing fence segment 20, the second tong 62 may be first removed from the top rail 50 so that the pickets 70 are removable. The locking rail 100 is then installed in its place. In some embodiments, two of the locking rails 100 may be formed by cutting apart a standard top rail 50 and trimming accordingly, although this does result in some overlap of the locking rail 100 and the top rail 50. Preferably, however, the locking rail 100 is extruded from a strong plastic material, such as PVC, such that there is minimal overlap between the locking rail 100 and the top rail 50, the second tong 62 being flush with the top rail 50 in such an embodiment (FIG. 10).

Figure 1:
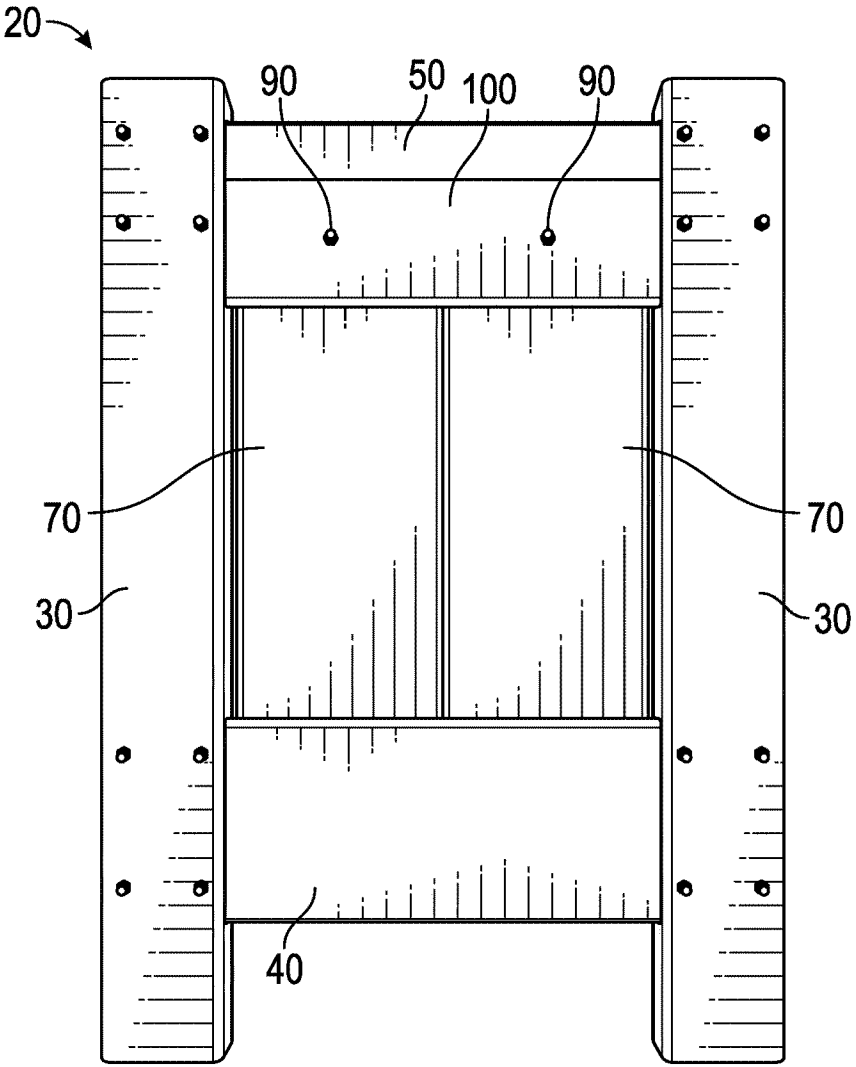
FIG. 1 is a front elevational view of the invention, showing a fence in an assembled configuration.
Figure 3:
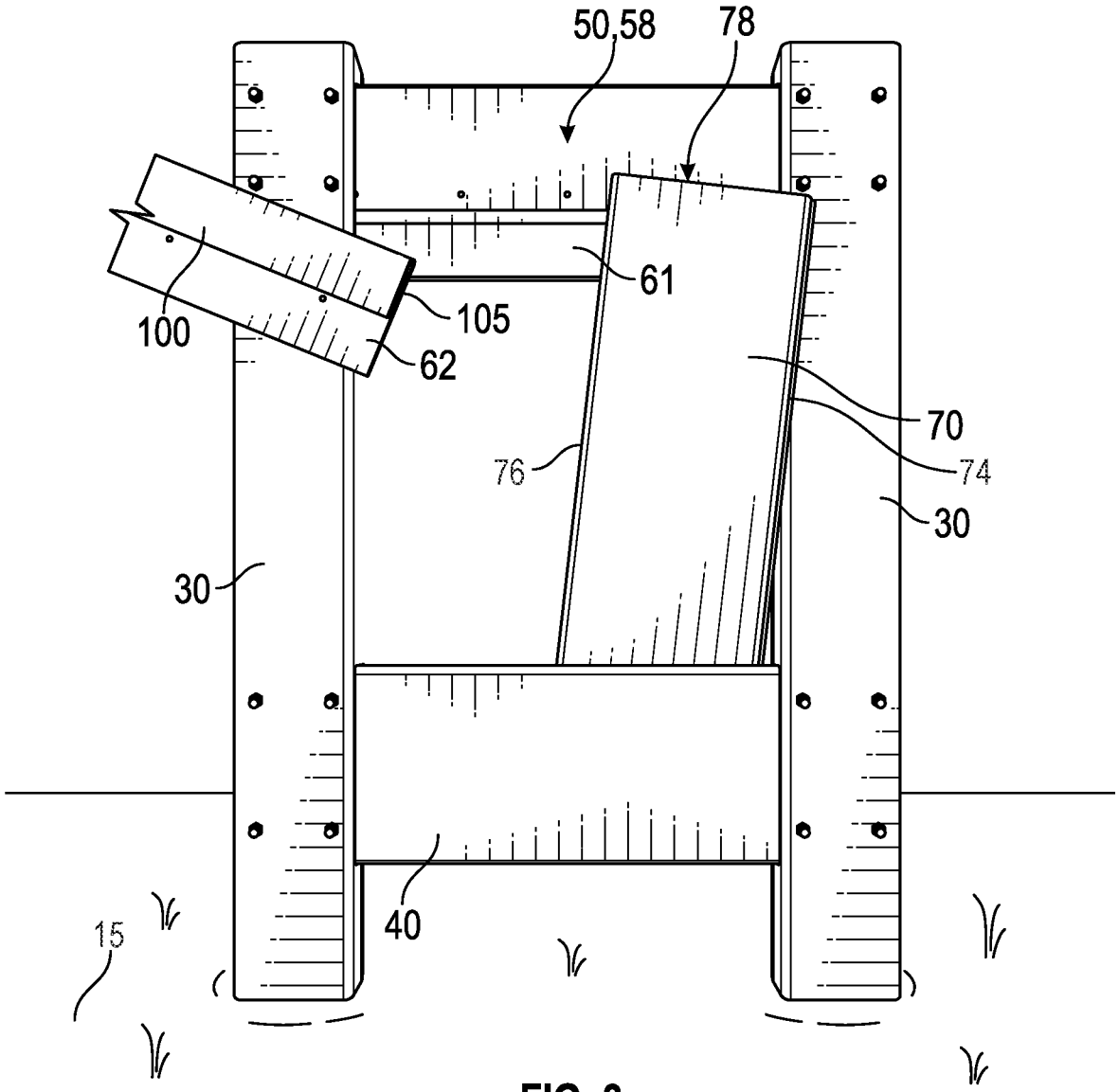
FIG. 3 is a front elevation view of the invention, illustrating pickets of the fence as removed from a bottom rail and the top rail of the invention.
Figure 4:
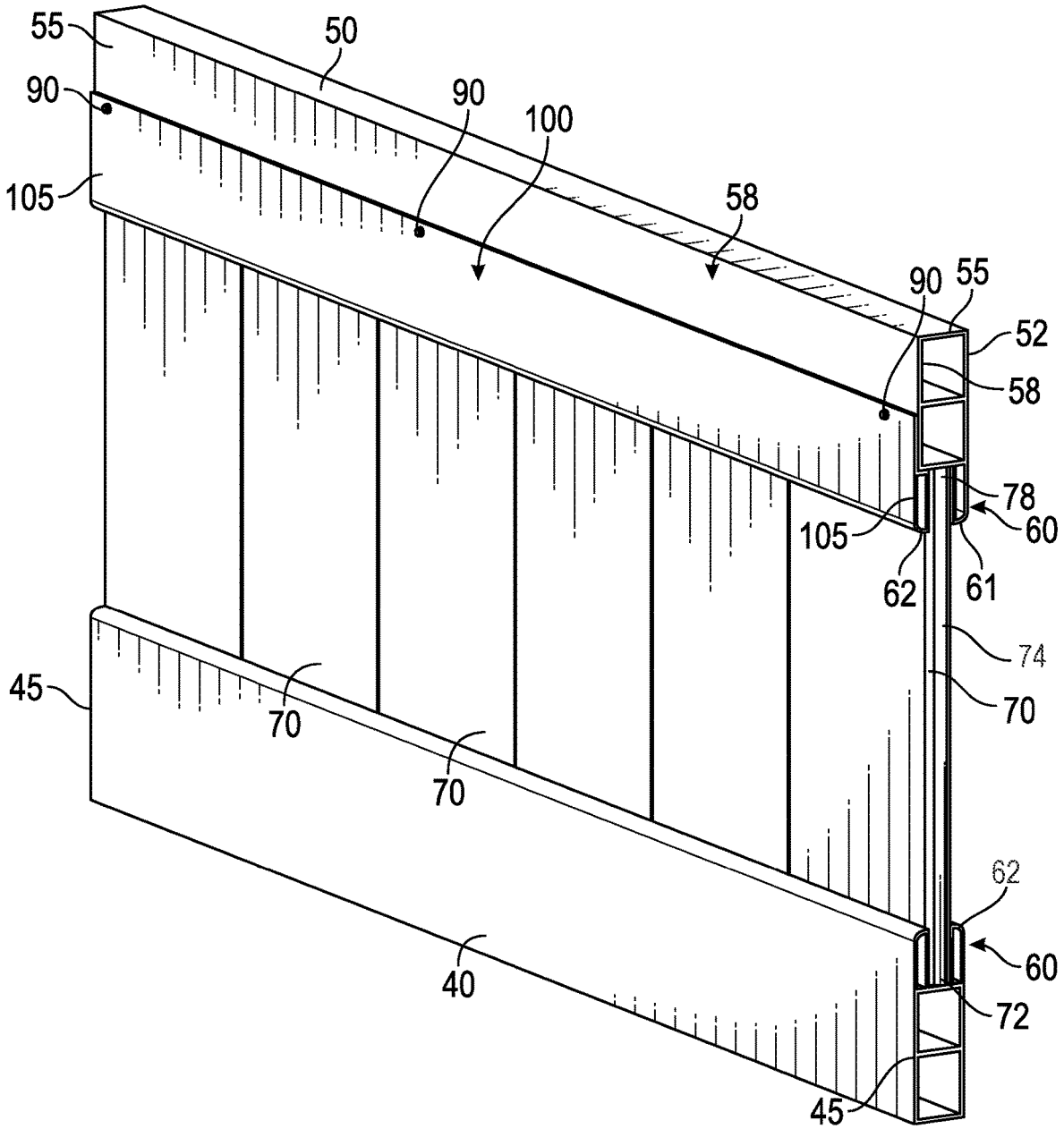
FIG. 4 is a side perspective view of the invention, illustrating the fence in the assembled configuration.
Figure 5:
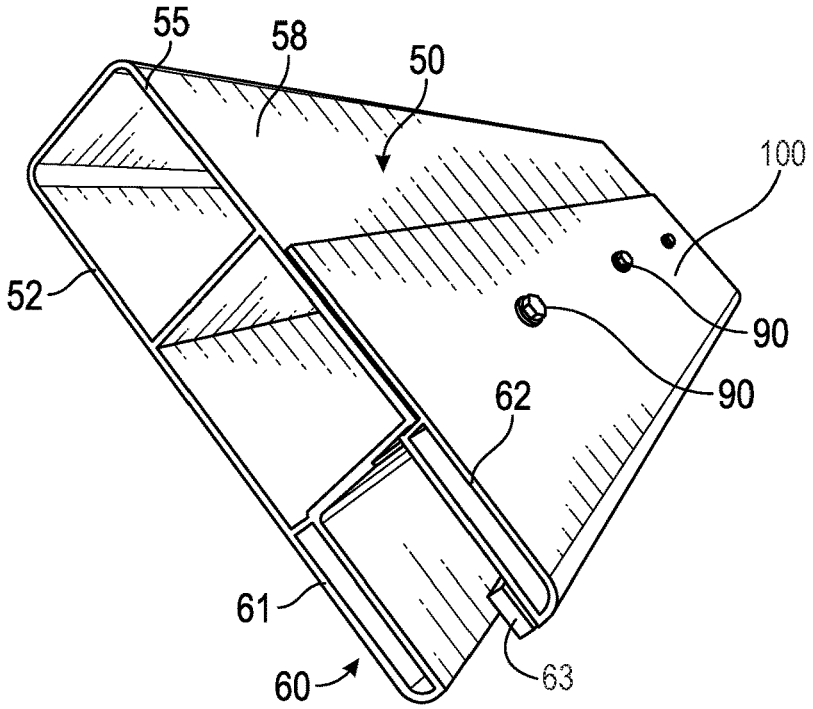
FIG. 5 is a side perspective view of the top rail and the locking rail of the invention in the assembled position, the pickets omitted for clarity of illustration.
Figure 6:
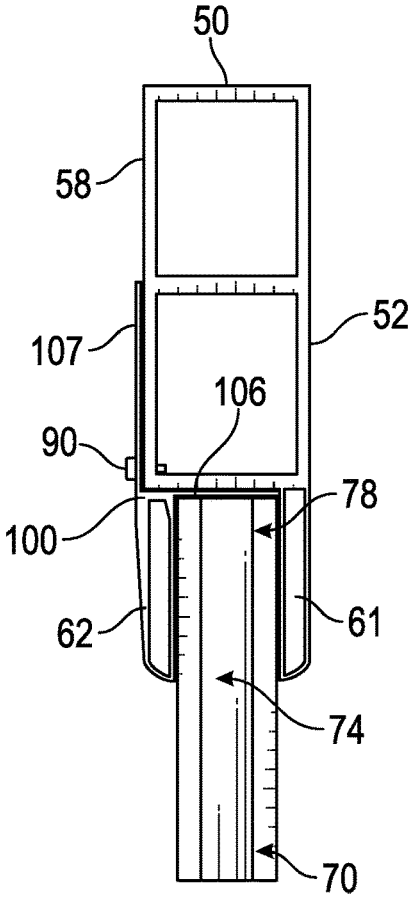
FIG. 6 is a side elevational view of an alternate embodiment of the invention, illustrating a vertical upper tang and a horizontal tang of the locking rail.

While a particular form of the invention has been illustrated and described, it will be apparent that various modifications can be made without departing from the spirit and scope of the invention. For example, FIGS. 1-3 show the fence segment 20 as having two pickets 70 for compact illustration purposes, but in typical installations many more pickets 70 are included in a fence segment 20, up to 18. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments. In particular, the process of dismantling the fence to protect it is an important attribute of the present invention, rather than just building a stronger fence or a more aerodynamic fence to resist wind forces.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An improvement for a fence segment of the type having two vertical posts supported by a ground surface, and a bottom rail having two opposing ends and an upward-facing U-shaped channel configured for receiving a plurality of pickets, the bottom rail disposed between the two vertical posts, the improvement comprising:

a top rail having two opposing ends, a first tong projecting downwardly, and configured to contact and retain the pickets at a first side of the top rail, the top rail configured for being disposed between the two vertical posts; and a locking rail having two opposing ends, a second tong projecting downwardly, and configured to contact and retain the pickets at an opposing second side of the top rail, the locking rail fixed with the top rail with a plurality of mechanical fasteners such that a vertical side of the locking rail, which includes a top edge of the locking rail and forms part of the second tong, is flush with the second side of the top rail.

2. The improvement of claim 1 wherein the top rail and the locking rail are integrally formed with a living hinge formed therebetween.

3. The improvement of claim 2 wherein the living hinge is formed at the top edge of the locking rail.

4. The improvement of claim 2 wherein the living hinge is formed at one of the ends of the top rail and one of the ends of the locking rail.

5. The improvement of claim 1 wherein, with the top rail and the locking rail mutually affixed, the top rail and the locking rail are configured for being received in respective recesses of the vertical posts.

6. The improvement of claim 1 wherein the locking rail is fixed with the top rail with the plurality of mechanical fasteners such that the plurality of mechanical fasteners pass through at least the locking rail at locations above the second tong such that the plurality of fasteners are configured to be disposed above the plurality of pickets without extending into or passing through the plurality of pickets.

7. A method of protecting a fence from strong winds, comprising the steps:

providing an improvement for a fence segment of the type having two vertical posts supported by a ground surface, and a bottom rail having two opposing ends and an upward-facing U-shaped channel configured for receiving a plurality of pickets, the bottom rail disposed between the two vertical posts, the improvement comprising a top rail having two opposing ends, a first tong projecting downwardly from the top rail, the top rail configured to contact and retain the pickets at a first side of the top rail, the top rail configured for being disposed between the two vertical posts; and a locking rail having two opposing ends, a second tong projecting downwardly, and configured to contact and retain the pickets at an opposing second side of the top rail, the locking rail fixed with the top rail with a plurality of mechanical fasteners such that a vertical side of the locking rail, which includes a top edge of the locking rail and forms part of the second tong, is flush with the second side of the top rail;

removing the mechanical fasteners;

removing the locking rail away from the pickets;

removing the pickets from the fence segment;

waiting for the strong winds to recede;

placing the pickets back into the U-shaped channel of the bottom rail and against the first tong of the top rail while moving the locking rail towards the pickets; and securing the locking rail to the top rail with the mechanical fasteners to secure the pickets in the fence segment.

8. The method of claim 7 wherein, in the provided improvement, the locking rail is fixed with the top rail with the plurality of mechanical fasteners such that the plurality of mechanical fasteners pass through at least the locking rail at locations above the second tong such that the plurality of fasteners are configured to be disposed above the plurality of pickets without extending into or passing through the plurality of pickets.

9. A method of protecting a fence from strong winds, comprising the steps:

providing an improvement for a fence segment of the type having two vertical posts supported by a ground surface, a bottom rail and a top rail, each of the bottom and top rails having two opposing ends and disposed between the two vertical posts, the bottom rail and the top rail each having opposing U-shaped channels between which are disposed a plurality of pickets, the pickets each having top and bottom ends captured by the U-shaped channels of the top and bottom rails, respectively; the top rail having a first tong and a second tong each projecting downwardly from the top rail, the top rail configured to contact and retain the pickets at a first side of the top rail with the first tong and at a second side of the top rail with the second tong;

removing the second tong of the top rail;

providing a locking rail having two opposing ends, a tong of the locking rail projecting downwardly, and configured to contact and retain the pickets at the second side of the top rail, the locking rail fixed with the top rail with a plurality of mechanical fasteners;

removing the mechanical fasteners;

removing the locking rail away from the pickets;

removing the pickets from the fence segment;

waiting for the strong winds to recede;

placing the pickets back into the U-shaped channel of the bottom rail and against the first tong of the top rail while moving the locking rail towards the pickets; and securing the locking rail to the top rail with the mechanical fasteners to secure the pickets in the fence segment.

* * * * *